US011001027B2

(12) United States Patent
Greenfield

(10) Patent No.: US 11,001,027 B2
(45) Date of Patent: May 11, 2021

(54) METHODS AND APPARATUS AND SYSTEMS FOR ESTABLISHING A REGISTERED SCORE, SLIT OR SLOT IN A CORRUGATED BOARD, AND ARTICLES PRODUCED THERE FROM

(71) Applicant: SCORRBOARD, LLC, Renton, WA (US)

(72) Inventor: Giles Greenfield, Renton, WA (US)

(73) Assignee: Scorrboard LLC, Tukwila, WA (US)

( * ) Notice: Subject to any disclaimer, the term of this patent is extended or adjusted under 35 U.S.C. 154(b) by 349 days.

(21) Appl. No.: 15/677,965

(22) Filed: Aug. 15, 2017

(65) Prior Publication Data

US 2017/0341331 A1 Nov. 30, 2017

Related U.S. Application Data

(63) Continuation of application No. 14/855,354, filed on Sep. 15, 2015, now Pat. No. 10,363,717, which is a (Continued)

(51) Int. Cl.

| | |
|---|---|
| ***B31B 50/25*** | (2017.01) |
| ***B31F 1/08*** | (2006.01) |
| ***B31B 50/14*** | (2017.01) |

(52) U.S. Cl.

CPC ..... *B31B 50/25* (2017.08); *B31F 1/08* (2013.01); *B31B 50/14* (2017.08)

(58) Field of Classification Search

CPC ..... B31F 1/08; B31B 50/14; B31B 50/252; B31B 50/25; B31B 50/26; B31B 50/262; (Continued)

(56) References Cited

U.S. PATENT DOCUMENTS

| | | | |
|---|---|---|---|
| 479,999 | A | 8/1892 | Thompson |
| 762,033 | A | 6/1904 | Ferres |

(Continued)

FOREIGN PATENT DOCUMENTS

| | | |
|---|---|---|
| AU | 2014232272 | 10/2015 |
| AU | 2014265869 | 10/2015 |

(Continued)

OTHER PUBLICATIONS

EMS Innovations Dispos-A-Board, published on Youtube.com on Mar. 2, 2012, retrieved from URL https://www.youtube.com/watch?v=SEs-wKU5ht4 on Apr. 29, 2020 (Year: 2012).*

(Continued)

*Primary Examiner* — Valentin Neacsu

(74) *Attorney, Agent, or Firm* — FisherBroyles LLP; Kevin D. Jablonski

(57) ABSTRACT

Methods, apparatus, and systems increase converting accuracy and consistency of corrugated articles of manufacture such as blanks, intermediates or converted structures to minimize unintended gap variations, fishtail variations and visual discord as well as to minimize unintentional loss of strength due to conversion of such articles. The constitution of converted articles formed from a corrugated board blanks according to the invention comprises at least one intelligently located score, slit or slot (hereinafter collectively "registered modification") based upon knowledge of the corrugated board's fluted medium, including the absolute relative location of at least one fluted medium feature and/or the fluted medium geometry, such as its pitch.

7 Claims, 1 Drawing Sheet

Related U.S. Application Data continuation of application No. PCT/US2014/030916, filed on Mar. 17, 2014.

(60) Provisional application No. 61/802,126, filed on Mar. 15, 2013.

(58) Field of Classification Search
CPC ..... Y10T 428/24628; Y10T 428/24694; Y10T 428/24727; B32B 29/08
USPC ..... 493/59, 60, 68, 79, 127; 428/174, 182, 428/186
See application file for complete search history.

(56) References Cited

U.S. PATENT DOCUMENTS 1,504,218 A 8/1924 Crowell
1,582,841 A 4/1926 Lorenz
1,620,367 A 3/1927 Lion
1,692,720 A 11/1928 Cannard
1,863,973 A 6/1932 Ellis, Jr.
1,924,873 A 8/1933 Moone
2,054,867 A 9/1936 Rudin et al.
2,089,898 A 8/1937 Kappler
RE20,970 E 1/1939 Rowe et al.
2,359,314 A 10/1944 Klein et al.
2,409,195 A * 10/1946 Crawford ..... A61F 5/058 602/4
2,474,381 A 6/1949 Bergstein
2,474,391 A * 6/1949 Bergstein ..... B31D 3/04 264/160
2,485,020 A * 10/1949 Staude ..... B31B 50/00 493/365
2,503,874 A 4/1950 Ives
2,651,448 A 8/1950 Dusseault
2,547,880 A 4/1951 Meyer et al.
2,576,278 A * 11/1951 Bode ..... B65D 65/403 428/186
2,758,047 A 8/1956 Dowd
2,960,145 A 11/1960 Ruegenberg
3,002,876 A 10/1961 Rosati
3,011,602 A 12/1961 Ensrud et al.
3,039,372 A * 6/1962 La Bombard ..... B31F 1/08 493/396
3,122,300 A * 2/1964 La Bombard ..... B65D 5/4266 229/100
3,156,599 A 11/1964 Keesee
3,178,494 A 4/1965 Tisdale
3,290,205 A 12/1966 Goldstein et al.
3,449,157 A 6/1969 Wandel
3,526,566 A * 9/1970 McIlvain, Jr. ..... B31F 1/0012 428/121
3,529,516 A * 9/1970 Pullen ..... B65D 5/4266 493/59
3,542,636 A 11/1970 Wandel
3,735,674 A * 5/1973 Haddock ..... B31B 50/00 493/354
3,773,587 A 11/1973 Flewweling
4,034,135 A 7/1977 Passmore et al.
4,086,116 A * 4/1978 Yazaki ..... B31F 1/2804 156/205
4,126,508 A 11/1978 Hoelzinger
4,140,564 A 2/1979 Schrader
4,179,253 A 12/1979 Lightfoot
4,259,950 A * 4/1981 Klippel ..... A61F 5/05883 128/870
4,268,555 A 5/1981 Kantz
4,285,764 A 8/1981 Salvai
4,437,850 A 3/1984 Ono
4,437,851 A 3/1984 Salenbo
4,541,895 A 9/1985 Albert
4,544,597 A 10/1985 Peer, Jr. et al.
4,618,391 A * 10/1986 Torti ..... B23D 36/0058 156/353
4,657,611 A 4/1987 Guins
4,693,413 A 9/1987 McFarland et al.
4,748,067 A 5/1988 Cline
4,800,286 A * 1/1989 Brears ..... G01B 11/026 250/227.11
4,800,826 A 1/1989 Shiskin
4,886,563 A 12/1989 Bennett et al.
4,931,346 A 6/1990 Nogueras
4,935,082 A 6/1990 Bennett et al.
5,156,901 A * 10/1992 Tanaka ..... B32B 29/08 428/182
5,313,167 A * 5/1994 Marshall ..... G01N 33/346 324/632
5,339,577 A 8/1994 Snyder
5,356,364 A 10/1994 Veith et al.
5,419,796 A 5/1995 Miller
5,508,083 A 4/1996 Chapman, Jr.
5,514,970 A * 5/1996 Marshall ..... G01N 22/04 162/263
5,537,936 A 7/1996 Cordrey
5,581,353 A * 12/1996 Taylor ..... B31F 1/2831 250/559.23
5,582,571 A * 12/1996 Simpson ..... B26F 1/18 493/355
5,589,257 A 12/1996 Carriker et al.
5,630,903 A 5/1997 Knorr et al.
5,687,517 A 11/1997 Wiercinski et al.
5,690,601 A * 11/1997 Cummings ..... B31F 1/0012 493/340
5,733,403 A * 3/1998 Morley ..... B31D 3/005 156/193
5,799,861 A * 9/1998 Bonner ..... B32B 29/08 229/198.1
5,857,395 A * 1/1999 Bohm ..... B23D 35/008 493/227
5,894,046 A * 4/1999 Kim ..... B31F 1/28 428/182
5,944,016 A * 8/1999 Ferko, III ..... A61F 5/05883 128/869
6,032,713 A * 3/2000 Ishibuchi ..... B31F 1/2813 156/205
6,056,840 A * 5/2000 Mills ..... B29C 53/063 156/217
6,139,938 A 10/2000 Lingle et al.
6,143,113 A 11/2000 Berube
6,153,037 A 11/2000 Kim et al.
6,162,155 A 12/2000 Gordon et al.
6,261,666 B1 7/2001 Enderby et al.
6,325,881 B1 * 12/2001 Ishibuchi ..... B31F 1/2813 156/210
D467,204 S * 12/2002 Andresen ..... D12/128
6,508,751 B1 * 1/2003 Weishew ..... B31B 50/00 493/160
6,800,052 B1 10/2004 Abe
6,836,331 B2 * 12/2004 Reis ..... B31F 1/2831 356/237.1
6,871,480 B1 3/2005 Goodrich
7,255,300 B2 * 8/2007 Johnston ..... B01D 25/001 242/412.1
7,413,629 B2 8/2008 Fisher et al.
7,909,954 B2 * 3/2011 Johnston ..... B01D 25/001 156/195
7,963,899 B2 6/2011 Papsdorf et al.
8,012,309 B2 9/2011 Pare et al.
8,771,579 B2 7/2014 Kohler
10,363,717 B2 * 7/2019 Greenfield ..... B31B 50/25
10,800,133 B2 10/2020 Greenfield
2001/0001410 A1 5/2001 Ishibuchi et al.
2003/0137667 A1 * 7/2003 Reis ..... B31F 1/2831 356/429
2004/0076798 A1 4/2004 Larsson et al.
2004/0089412 A1 5/2004 Topolkaraev
2004/0159693 A1 * 8/2004 Adachi ..... B26D 5/02 225/3
2004/0224828 A1 11/2004 Nelles
2005/0209075 A1 * 9/2005 Kocherga ..... B31F 1/10 493/11

(56) References Cited

U.S. PATENT DOCUMENTS

| | | | | |
|---|---|---|---|---|
| 2006/0151655 | A1* | 7/2006 | Johnston | B01D 25/001 242/410 |
| 2006/0246261 | A1 | 11/2006 | Kasabo et al. | |
| 2007/0098887 | A1 | 5/2007 | Kohler | |
| 2008/0300825 | A1 | 12/2008 | Ishibuchi et al. | |
| 2009/0029840 | A1 | 1/2009 | Chen | |
| 2009/0117376 | A1* | 5/2009 | Bloembergen | B05C 1/0813 428/341 |
| 2010/0028611 | A1 | 2/2010 | Adie | |
| 2010/0080941 | A1 | 4/2010 | McCarville et al. | |
| 2010/0163154 | A1* | 7/2010 | Masuda | B65H 26/02 156/64 |
| 2010/0331160 | A1 | 12/2010 | Kohler | |
| 2011/0014433 | A1 | 1/2011 | Trani et al. | |
| 2011/0114712 | A1 | 5/2011 | Malo et al. | |
| 2011/0177298 | A1 | 7/2011 | Gardiner | |
| 2011/0226847 | A1 | 9/2011 | Nakano | |
| 2012/0205429 | A1 | 8/2012 | Trani et al. | |
| 2012/0226250 | A1* | 9/2012 | Sato | A61F 13/51104 604/367 |
| 2012/0276341 | A1 | 11/2012 | Lake et al. | |
| 2013/0139837 | A1 | 6/2013 | Kaljura et al. | |
| 2014/0044923 | A1 | 2/2014 | Gelli | |
| 2014/0141113 | A1 | 5/2014 | Kohler | |
| 2014/0166520 | A1 | 6/2014 | Hoppe et al. | |
| 2015/0010734 | A1 | 1/2015 | Van Berlo | |
| 2015/0053349 | A1* | 2/2015 | Mori | B31F 1/2836 156/355 |
| 2015/0114249 | A1 | 4/2015 | Comorre | |
| 2015/0307755 | A1 | 10/2015 | Krumm et al. | |
| 2016/0271897 | A1 | 9/2016 | Greenfield | |
| 2017/0157894 | A9 | 6/2017 | Greenfield | |
| 2017/0274616 | A1 | 9/2017 | Greenfield | |
| 2017/0282489 | A1 | 10/2017 | Greenfield | |
| 2017/0305103 | A1 | 10/2017 | Greenfield | |
| 2017/0341331 | A1 | 11/2017 | Greenfield | |
| 2019/0232600 | A1 | 8/2019 | Greenfield | |

FOREIGN PATENT DOCUMENTS

| | | | |
|---|---|---|---|
| CA | 2907431 | | 9/2014 |
| CA | 2907392 | | 11/2014 |
| CL | 1997000270 | A | 10/1997 |
| CL | 2004000310 | A | 3/2005 |
| CL | 2012002694 | A | 3/2013 |
| CL | 2014000247 | | 1/2014 |
| CL | 56755 | | 3/2014 |
| CL | 2013002596 | A | 4/2014 |
| CL | 2014003401 | A | 4/2015 |
| CL | 2015002781 | | 9/2015 |
| CL | 2018002987 | A1 | 2/2019 |
| CL | 2018002988 | A1 | 2/2019 |
| CL | 2018002989 | A1 | 2/2019 |
| CL | 2018002990 | A1 | 2/2019 |
| CN | 1092355 | A | 9/1994 |
| CN | 1126457 | | 7/1996 |
| CN | 1148360 | A | 4/1997 |
| CN | 1150403 | A | 5/1997 |
| CN | 1469802 | A | 1/2004 |
| CN | 2806125 | Y | 8/2006 |
| CN | 2841324 | | 11/2006 |
| CN | 101259765 | A | 9/2008 |
| CN | 101772457 | A | 7/2010 |
| CN | 101952120 | | 1/2011 |
| CN | 102105300 | A | 6/2011 |
| CN | 102470624 | A | 5/2012 |
| CN | 202986283 | U | 6/2013 |
| CN | 104494211 | A | 4/2015 |
| CN | 105121147 | | 12/2015 |
| CN | 105121148 | | 12/2015 |
| EP | 1110709 | A2 | 6/2001 |
| EP | 14797031.3 | | 3/2013 |
| EP | 2969522 | | 1/2016 |
| EP | 2969526 | | 1/2016 |
| EP | 3436649 | A1 | 2/2019 |
| EP | 3445583 | A4 | 2/2019 |
| FR | 2550724 | | 2/1985 |
| FR | 2594160 | A3 | 8/1987 |
| FR | 2596033 | | 9/1987 |
| GB | 594328 | A | 11/1947 |
| GB | 977069 | A | 12/1961 |
| GB | 1542765 | | 3/1979 |
| GB | 2144077 | A | 2/1985 |
| GB | 2258189 | A | 2/1993 |
| GB | 2301316 | | 12/1996 |
| GB | 2368074 | A | 4/2002 |
| HK | 1212298 | | 6/2016 |
| HK | 1212302 | | 6/2016 |
| JP | S4972089 | U | 7/1974 |
| JP | S51-115191 | A | 10/1976 |
| JP | S52-156090 | A | 12/1977 |
| JP | 62-116133 | | 5/1987 |
| JP | H02-63358 | A | 3/1990 |
| JP | 02-235623 | A | 9/1990 |
| JP | H03-26534 | A | 2/1991 |
| JP | H03-106031 | | 11/1991 |
| JP | 03-275292 | A | 12/1991 |
| JP | 1996-309889 | A | 11/1996 |
| JP | H09-39119 | A | 2/1997 |
| JP | H10-50775 | A | 2/1998 |
| JP | 2003291230 | A | 6/2001 |
| JP | 2005509545 | A | 4/2005 |
| JP | 2007152689 | A | 6/2007 |
| JP | 2009125998 | A | 6/2009 |
| JP | 2009172942 | A | 8/2009 |
| JP | 2011/079207 | A | 4/2011 |
| JP | 2011079207 | A | 4/2011 |
| JP | 2013-523492 | | 6/2013 |
| JP | 2016-519008 | | 6/2016 |
| JP | 2016515959 | | 6/2016 |
| JP | 2019514726 | A | 6/2019 |
| KR | 2000-0058870 | | 10/2000 |
| KR | 2000/0058870 | A | 10/2000 |
| KR | 1008/66390 | B1 | 11/2008 |
| KR | 100866390 | B1 | 11/2008 |
| KR | 20110104772 | A | 9/2011 |
| KR | 20160008170 | | 1/2016 |
| KR | 20160008518 | | 1/2016 |
| PH | 12015502380 | | 2/2016 |
| PH | 12015502381 | | 2/2016 |
| WO | 93/23241 | A1 | 11/1993 |
| WO | 9427813 | A1 | 12/1994 |
| WO | WO 95/35204 | A1 | 12/1995 |
| WO | 9818614 | | 5/1998 |
| WO | 1999047347 | | 9/1999 |
| WO | 01/58679 | A1 | 8/2001 |
| WO | 2004052635 | A1 | 6/2004 |
| WO | 2009/101526 | A1 | 8/2009 |
| WO | 2012128604 | | 9/2012 |
| WO | 2013/019126 | A1 | 2/2013 |
| WO | WO 2013/098353 | A1 | 7/2013 |
| WO | 2014146036 | | 9/2014 |
| WO | 2014186043 | | 11/2014 |
| WO | WO 2015/128546 | A1 | 9/2015 |
| WO | 2015178766 | A1 | 11/2015 |
| WO | 2017184447 | A1 | 10/2017 |

OTHER PUBLICATIONS

European Patent Office; Extended European Search Report dated Nov. 27, 2019; EPO Application No. 17786318.0; pp. 1-8.

European Patent Office; Extended European Search Report dated Nov. 28, 2019; EPO Application No. 17776824.9; pp. 1-7.

European Patent Office; Extended European Search Report dated Nov. 21, 2019; EPO Application No. 17786382.6; pp. 1-8.

European Patent Office; Extended European Search Report dated Nov. 21, 2019; EPO Application No. 17786317.2; pp. 1-7.

European Patent Office; Extended European Search Report dated Nov. 7, 2019; EPO Application No. 17786383.4; pp. 1-7.

European Extended Search Report; European Patent Organization; EP 14797031.3; dated Oct. 31, 2016; pp. 1-8.

(56) References Cited

OTHER PUBLICATIONS

International Search Report & Written Opinion dated Jun. 15, 2017; PCT Appl. No. US17/23611 filed Mar. 22, 2017.
International Search Report & WrittenOpinion dated Jun. 27, 2017; PCT Appl. No. US17/25510; filed Mar. 31, 2017.
International Search Report & Written Opinion dated Jun. 30, 2017; PCT Appl. No. US17/027624; filed Apr. 14, 2017.
Internation Search Report & Written Opinion, dated Jul. 21, 2017; PCT/US2017/025531, filed Mar. 31, 2017.
International Search Report and Written Opinion dated Jul. 6, 2017; PCT Appl. US2017/25491, filed Mar. 31, 2017.
European Patent Office; Extended European Search Report dated Jul. 15, 2019; EP Application No. 17771068.8; pp. 1-6.
Supplementary European Search Report for European Application No. EP14762807, The Hauge dated Jun. 21, 2106, pp. 5.
First Office action and Search Report along with English Translation for Chinese Application No. 201480016009X, dated Aug. 3, 2016, pp. 17.
First Examination Report for New Zealan Patent Application Serial No. 712616, New Zealand Intellectual Property Office, dated Nov. 30, 2015, pp. 2.
First Examination Report for New Zealan Patent Application Serial No. 712611 New Zealand Intellectual Property Office, dated Nov. 30, 2015, pp. 2.
International Search Report based on PCT/US2014/030916; dated Aug. 22, 2014, pp. 3.
International Search Report based on PCT/US2014/030909; dated Aug. 20, 2014, pp. 3.
First Patent Examination Report for Australian Patent Application Serial Appl. No. 2014232272, Australian Government, IP Australlia, dated Mar. 3, 2016, pp. 3.
First Patent Examination Report for Australian Patent Application Serial No. 2014265869, Australian Government, IP Australlia, dated Apr. 21 2016, pp. 2.
First Patent Examination Report for Australian Patent Application Serial No. 712611, Australian Government, IP Australlia, dated Jul. 6, 2016, pp. 3.
WO dated Aug. 20, 2009 for PCT/IB2009/000271 filed Feb. 13, 2009.
Mikami et al.; "Analysis of normal compression strength of corrugated board sheet by the finite element method"; Journal of Packaging Science & Technology, Japan, vol. 13 No. 4, pp. 143-252.

* cited by examiner

METHODS AND APPARATUS AND SYSTEMS FOR ESTABLISHING A REGISTERED SCORE, SLIT OR SLOT IN A CORRUGATED BOARD, AND ARTICLES PRODUCED THERE FROM

PRIORITY CLAIM

The present application is a Continuation of co-pending U.S. patent application Ser. No. 14/855,354, filed Sep. 15, 2015; which application is a Continuation of International Patent Application Serial No. PCT/US2014/030916, entitled ESTABLISHING A REGISTERED SCORE, SLIT OR SLOT IN CORRUGATED BOARD, AND ARTICLES PRODUCED THEREFROM, filed Mar. 17, 2014; which claims the benefit of U.S. Provisional Patent Application Ser. No. 61/802,126, filed Mar. 15, 2013; all of the foregoing applications are incorporated herein by reference in their entireties.

BACKGROUND

Traditionally, corrugated boards or blanks were converted into boxes, containers or other three-dimensional forms without consideration of how the location of folds, creases, edges, and corners necessary to accomplish conversion would affect the corrugated board material. As a result, scores, slits and slots would be formed in the blank without meaningful concern for the structural integrity of the converted form. While such oversight poses few risks to the structural integrity of a converted form made from a homogeneous material, the resulting folds, creases, corners or edges imposed on the corrugated board material would compromise the outer liner integrity and/or crush the inner liner and fluted mediums in the converted article. This consequence not only decreased structural performance of a converted article, but significantly reduced its number of reuse cycles. Moreover, because the scores, for example, did not evenly affect the corrugated board, the folds, creases, corners or edges were often uneven, which resulted in unintended flap gaps, fishtails and the like, not to mention overall visual discord.

Conventional wisdom dictated that outer liner integrity issues could be resolved by increasing the basis weight of the liner, modifying the geometry of the score, or adding localized reinforcements. However, increasing material strength not only increased costs associated with the blanks and increased transportation costs, but also compromised the structural integrity of the inner liner and/or fluted medium. The converse was also true: minimizing issues with inner liner and/or fluted medium crushing and the like would not solve the outer liner issues.

BRIEF DESCRIPTION OF DRAWINGS

Aspects and many of the attendant advantages of the claims will become more readily appreciated as the same become better understood by reference to the following detailed description, when taken in conjunction with the accompanying drawings, wherein:

DETAILED DESCRIPTION

The following discussion is presented to enable a person skilled in the art to make and use the subject matter disclosed herein. The general principles described herein may be applied to embodiments and applications other than those detailed above without departing from the spirit and scope of the present detailed description. The present disclosure is not intended to be limited to the embodiments shown, but is to be accorded the widest scope consistent with the principles and features disclosed or suggested herein.

By way of overview, the subject matter discussed herein is directed to methods, apparatus, and systems for increasing converting accuracy and consistency of corrugated articles of manufacture such as blanks, intermediates or converted structures to minimize unintended gap variations, fishtail variations and visual discord as well as to minimize unintentional loss of strength due to conversion of such articles. The conversion of articles formed from corrugated board blanks according to the invention comprises intelligently locating a score, slit or slot (hereinafter collectively "registered modification") based upon knowledge of the corrugated board's fluted medium, including the absolute relative location of at least one fluted medium feature and/or the fluted medium geometry, such as its pitch.

Figure 1:
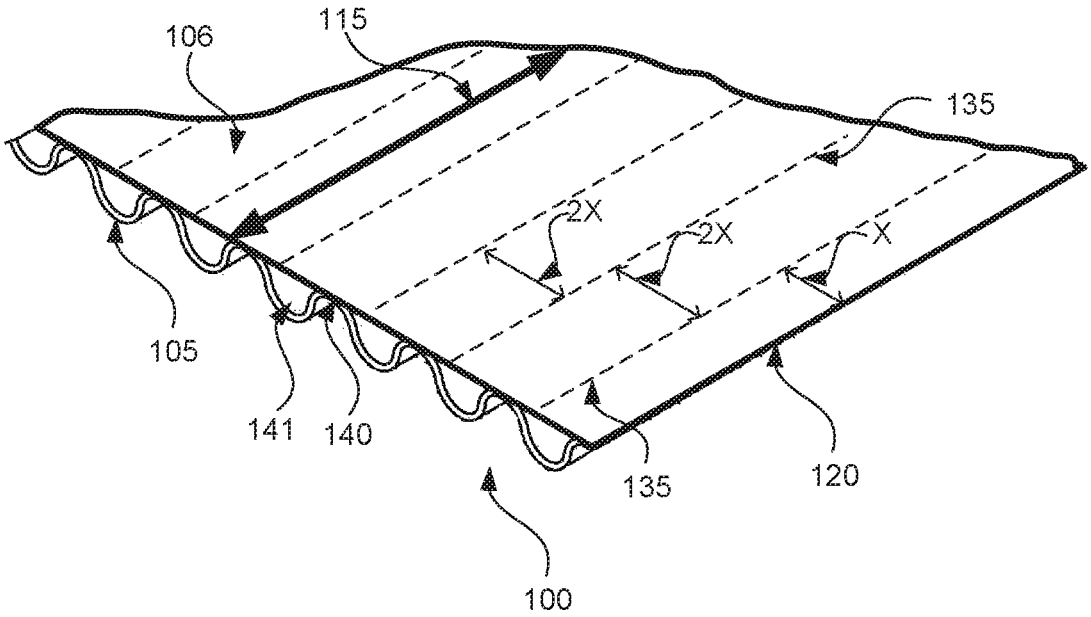
FIG. 1 is a diagram of a portion of resultant corrugated paper product that results from one or more register methods according to the subject matter disclosed herein.

Turning attention to FIG. 1, methods according to the subject matter described herein comprise establishing a registered modification 135 on a corrugated board 100 wherein the registered modification 135 is substantially at a constant distance "X" from a fluted medium feature, such as a peak 140 or a valley 141, in a direction orthogonal to the flute axis 115. In this sense, the modification 135 is said to be in registration with the fluted medium 105 and is referred to herein as a registered modification 135. It should be understood that the location for a registered modification 135 can be obtained in many ways including, but not limited to, considering the spatial location of at least one fluted medium 105 feature and the fluted medium's pitch quality (e.g., frequency and whether constant or variable); or the spatial location of a plurality of fluted medium 105 features to enable creation of a registered modification 135. Using either methodology and in addition to/in lieu of creation of a registered modification 135, at least one visual and/or machine discernible registration indicia 140 or 141 can be established on the corrugated board 100 to aid in the creation of future registered modifications 135.

Apparatus and systems enable determination of the registration information in one respect, and formation of the registered modification 135 in another respect. In the first respect, registration information of a corrugated board 100 can be obtained, for example, from engineering/manufacturing data about the board and/or inspection of the board (e.g., optical, sonic, thermal, etc.). In the second respect, formation of the registered modification can be accomplished, for example, by Complete Automated Manufacturing (CAM) machinery using information obtained in the first respect, or by creation of a registered edge 120 in a corrugated board 100 from which subsequent measurements or determinations for modification locations are made. As used herein, a registered edge 120 is one that is substantially at a constant displacement from a fluted medium 105 feature, such as a peak 140 or a valley 141, either of which runs parallel to the flute axis 115. In this sense, the edge 120 is said to be in registration with the fluted medium and corrugated board 100 possessing a registered edge 120 can be described as edge registered. Once a registered edge 120 has been established, registered modifications 135 can be made to the board 100 simply based upon knowledge of the fluted medium's pitch quality.

The subject matter is further directed to articles resulting from practice of the methods and/or use of the apparatus or systems herein described. In a first series of embodiments, such articles may be characterized as edge registered single or multiple wall corrugated board, edge registered single or multiple wall corrugated board blanks or such blanks that have been converted to a finished form. To fall within the scope, it is not necessary that such articles also have at least one registered modification 135 formed therein; it is only necessary that at least one edge 120 of the article be a registered edge 120 as that term is used herein.

Further detailing various embodiments, a first series of method embodiments comprises establishing a registered edge 120 in a corrugated board 100 prior to creating any modification 135 of the same. By establishing a registered edge 120, which is preferably parallel to the flute direction 115 (alternatively characterized as perpendicular to the presumptive weak axis of the corrugated board 100), any constant distance x there from along the registered edge 120, and in multiples of the fluted medium's pitch (i.e., period), will encounter substantially consistent mechanical properties of the corrugated board 100, particularly with respect to the fluted medium. In other words, if the distance from the registered edge 120 to a flute valley 141 in one direction is "x", the same distance "x" in the same direction anywhere along the registered edge will also terminate along the same flute valley 141.

The registered edge 120 can be established by ascertaining the run length location of a fluted medium feature, for example, a most lateral continuous valley, and cross cutting the corrugated board 100 along this fluted medium 105 feature. Since significant fluted medium 105 run-out along the flute axis 115 is rarely encountered in current corrugating production, the resulting edges 120 will form the trailing edge of one corrugated board 100 sheet and the leading edge of another. Furthermore, because there is no meaningful kerf to the cross cutting action, registry among sheets is maintained.

To ascertain the location of a fluted medium feature 140 or 141, a variety of inspection means (265 of FIG. 2) can be used, which include, but are not limited to, optical emitters and sensors, which detect changes in transmitted or back-scattered light to characterize the corrugated board 100; sonic transducers, which detect changes in material density and/or caliper of the corrugated board; and thermal emitters and sensors, which detect changes in transmitted or back-scattered heat signatures to characterize the corrugated board 100. Those persons skilled in the art will realize that alternative modes for detection can be used that rely upon the principles of the foregoing examples, such as millimeter wave technologies, moisture sensors, and the like.

Once the data regarding the relative location of the feature 140 or 141 of interest has been acquired, the data can be exploited to guide a trimming tool and/or stage upon which the corrugated board 100 is placed in order to effectuate the desired trimming actions. When completed, a flute-based registered edge 120 will have been established.

By establishing a registered edge 120, a registered modification 135 can be established through knowledge of the corrugated board's fluted medium pitch, and its quality. Presuming a constant pitch quality, the weak axis direction can be ascertained by using multiples of the fluted medium's period measured from the registered edge 120. For example, if the fluted medium is a "C" type and has a pitch "P" of 7.6 mm and if the registered edge 120 corresponds to a flute peak, then "n" multiples of 7.6 mm (n×P) as measured from the registered edge 120 will necessarily correspond to a flute peak, which may be a desired location to establish a registered modification 135. Because the registered edge 120 preferably sets the baseline location to which additional registered modifications 135 will relate, no further examination of the corrugated board 100 is needed to locate additional registered modifications 135.

In a second series of method embodiments, the subject matter comprises establishing a registered modification 135 in a corrugated board 100 not based upon a registered edge 120, but based upon the absolute relative location(s) of the fluted medium features. An advantage of a blank having a registered edge 120, for example, is that no further evaluation of the corrugated board 100 is necessary nor is any additional specialized equipment needed to form a registered modification 135. However, under certain circumstances it may be desirable to simply locate registered modifications 135 in non-edge registered articles. In such situations, the previously described inspection means can determine the spatial geometry of a fluted medium of a corrugated board 100 where after desired modifications 135 can be made to the board 100 that result in registered modifications 135.

Figure 2:
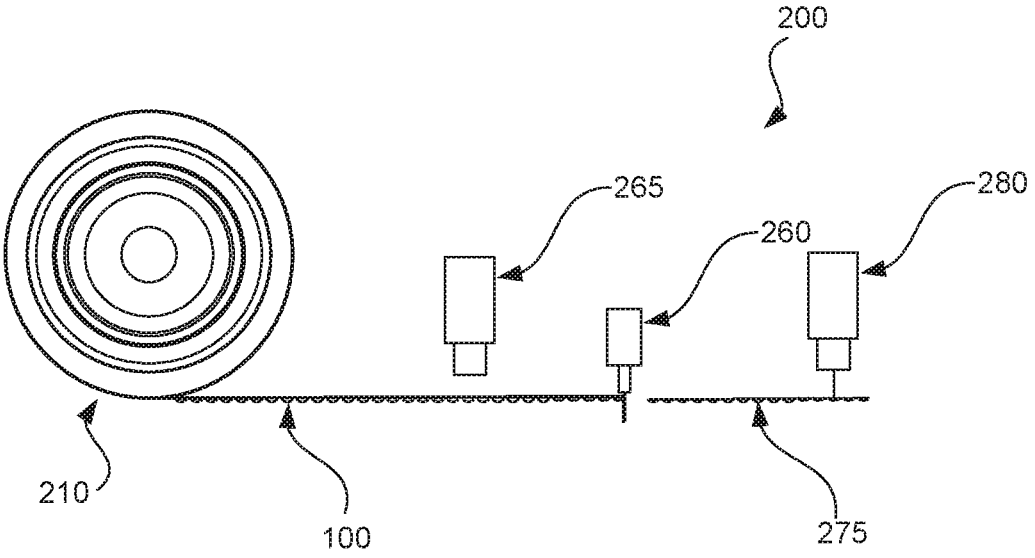
FIG. 2 is a diagram of aspects of a machine for feeding paper into a corrugating stage of a machine according to an embodiment of the subject matter disclosed herein.

FIG. 2 is a diagram of aspects of a machine for feeding paper into a corrugating stage of a machine according to an embodiment of the subject matter disclosed herein. While a wide variety of apparatus and systems 200 are available for carrying out the methods described herein, an exemplary system for creating a registered edge (120 of FIG. 1) and a registered modification (135 of FIG. 1) in the form of a score will now be described. Corrugated sheets 275 are created from a continuous web 210 of combined corrugated board 100, where a cross cutting knife 260 (cut-off knife) severs the web in register to a predetermined and repeatable point in a single flute. This cut-off operates continuously to cut sheets 275 that are always multiples of a single flute pitch. Therefore, if the knife 260 cuts precisely in the flute peak center, the sheets are always accurate multiples of the flute pitch. The board 100 is produced with the running direction at 90 degrees to the flute direction. Each successive sheet 275 is the same as the preceding one. When any such sheet 275 is introduced into a converting machine, it is placed relative to a front or side stop (depending on the direction it is to travel through the converting process), whereby the position of each and every flute valley is known relative to its edge(s).

In designing a box or container that the corrugated board 100 is to be converted into, scores, slits, slots, and the like that run parallel to the flutes are positioned accurately to be in register with the flutes. Scores, slits, slots may be imparted to the facing of the corrugated sheet by modification device such as a knife or laser etching apparatus 280. Boxes/containers have scores (for instance) always positioned in the same place relative to the flute pitch, which will have the effect of producing the same desirable folding effect and accuracy. Score-to-score design panel dimensions will always be multiples of the flute pitch employed when making the corrugated board/sheet itself. By locating a score in the valley of a flute, as viewed from the inside surface of the sheet being employed in making a box, for example, the folding process collapses the inner liner into the flute valley without crushing the flutes themselves, thereby preserving the essential strength of the corrugated board 100. By preserving the strength of the board 100, the corner of the box will have more strength than was previously possible when scores were not located in registration with the flute line/valley. This is because the "in-folded" liner functionally creates an arch or second flute in addition to occupying the flute valley, thereby providing dual means for enhancing corner strength. Locating registered modifications parallel to the flute valley also enhances the assembling accuracy and appearance of finished containers, which is also an attribute missing when non-registered modifications are used for converted articles.

Because of the high level of in-folding precision achieved when establishing registered scored corners in corrugated boards, it is both possible and desirable to create pseudo-radiused corners or folds. Pseudo-radiused corners are corner pairs or triplets that permit adjacent or proximately located corners or folds to mimic high degree corners or folds, that otherwise may compromise the structural integrity of the resulting converted article. As used herein, "proximately located" corners or folds are in-folds that are low pitch multiples from each other, e.g., 1, 2, or 3 flute periods or specifically, valleys. For example, a pair of adjacent or proximately located 45° corners or folds mimic a 90° corner; a triplet of 30° folds also mimic a 90° corner. Through the use of registered scores that necessarily limit in-folds to flute valleys, for example, it is possible to have adjacent or proximate located folds that increase the load handling capability of the converted article as opposed to decrease it as would be the case using prior art methods.

The embodiments discussed herein also provide opportunities for enhancing the performance of multiple wall corrugated board: by creating multiple wall corrugated board wherein the fluted mediums are registered with each other (such as when similar pitch mediums are used) or choosing pitch multiples where registration still occurs even with multiple pitches, the benefits of the invention such as increased accuracy and consistency as well as minimized loss of strength during conversion processes can be achieved.

Finally, articles within the scope set forth herein include at least one registered edge or at least one registered modification resulting from the practice of at least one method aspect of the present subject matter. Articles may, and desirably do, comprise both at least one registered edge and one registered modification. And as noted previously, articles may comprise single or multiple wall corrugated board, corrugated board blanks and/or converted corrugated boards such as containers, boxes, displays, or any other three-dimensional corrugated structure resulting from a converting process.

While the subject matter discussed herein is susceptible to various modifications and alternative constructions, certain illustrated embodiments thereof are shown in the drawings and have been described above in detail. It should be understood, however, that there is no intention to limit the claims to the specific forms disclosed, but on the contrary, the intention is to cover all modifications, alternative constructions, and equivalents falling within the spirit and scope of the claims.

What is claimed is:

1. A method, comprising:

feeding a corrugated board having a paper facing and having a fluted medium with repeating features to a board product machine and determining a plurality of locations of the repeating features of the fluted medium;

cutting the corrugated board to produce a paper board product in register to the repeating features, the paper board product including the fluted medium having the plurality of locations of respective repeating features and the paper facing; and modifying the paper facing to have a plurality of modifications respectively in register to the plurality of locations of respective repeating features while the fluted medium remains free from the plurality of modifications.

2. The method of claim 1 wherein determining comprises measuring a distance orthogonal to features.

3. The method of claim 1 wherein modifying comprises one of searing, slitting, cutting, scoring, or separating.

4. The method of claim 1 wherein modifying comprises scoring linear to a flute axis.

5. The method of claim 1 wherein the method further comprises affixing a second facing to the fluted medium.

6. The method of claim 1 wherein the method further comprises folding the paper board product into a blank.

7. The method of claim 1 wherein the method further comprises affixing a second fluted medium to the paper board product.

* * * * *